US007883180B2

(12) United States Patent
Cha et al.

(10) Patent No.: US 7,883,180 B2
(45) Date of Patent: Feb. 8, 2011

(54) NOZZLE PLATE OF INKJET PRINTHEAD AND METHOD OF MANUFACTURING THE NOZZLE PLATE

(75) Inventors: Tae-woon Cha, Seoul (KR); Seung-mo Lim, Suwon-si (KR); Sung-gyu Kang, Suwon-si (KR); Jae-woo Chung, Yongin-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 834 days.

(21) Appl. No.: 11/766,283

(22) Filed: Jun. 21, 2007

(65) Prior Publication Data

US 2008/0129780 A1 Jun. 5, 2008

(30) Foreign Application Priority Data

Dec. 1, 2006 (KR) ..... 10-2006-0120978

(51) Int. Cl.
*B41J 2/14* (2006.01)

(52) U.S. Cl. ..... 347/47

(58) Field of Classification Search ..... 347/45–47
See application file for complete search history.

(56) References Cited

U.S. PATENT DOCUMENTS 7,434,913 B2 * 10/2008 Suzuki et al. ..... 347/45
7,441,871 B2 * 10/2008 Nishijima ..... 347/47

* cited by examiner

*Primary Examiner*—An H Do
(74) *Attorney, Agent, or Firm*—Stanzione & Kim, LLP

(57) ABSTRACT

A nozzle plate of an inkjet printhead, and a method of manufacturing the nozzle plate. The nozzle plate includes a substrate through which nozzles are formed; an ink-philic coating layer formed on an outer surface of the substrate and inner walls of the nozzles; and an ink-phobic coating layer selectively formed on the ink-philic coating layer disposed around the nozzles.

7 Claims, 9 Drawing Sheets

NOZZLE PLATE OF INKJET PRINTHEAD AND METHOD OF MANUFACTURING THE NOZZLE PLATE

CROSS-REFERENCE TO RELATED APPLICATIONS

This application claims the benefit of Korean Patent Application No. 10-2006-0120978, filed on Dec. 1, 2006, in the Korean Intellectual Property Office, the disclosure of which is incorporated herein in its entirety by reference.

BACKGROUND OF THE INVENTION

1. Field of the Invention

The present general inventive concept relates to a nozzle plate of an inkjet printhead, and more particularly, to a nozzle plate of an inkjet printhead, which has excellent ink ejecting performance, and a method of manufacturing the nozzle plate.

2. Description of the Related Art

An inkjet printhead is an apparatus that ejects very small droplets of printing ink on a printing medium in a desired position to print an image in a predetermined color. Inkjet printheads may be largely classified into thermal inkjet printheads and piezoelectric inkjet printheads. The thermal inkjet printhead produces bubbles using a thermal source and ejects ink due to the expansive force of the bubbles. The piezoelectric inkjet printhead applies pressure generated by deforming a piezoelectric material to ink and ejects the ink due to the generated pressure.

FIG. 1 is a schematic cross-sectional view of a conventional piezoelectric inkjet printhead as an example of a conventional inkjet printhead.

Referring to FIG. 1, a manifold 11, a plurality of restrictors 12, and a plurality of pressure chambers 13 are formed in a flow path plate 10 and constitute an ink flow path. A vibrating plate 20 is adhered to a top surface of the flow path plate 10. The vibrating plate 20 is deformed due to the drive of a piezoelectric actuator 40. A nozzle plate 30 having a plurality of nozzles 31 is adhered to a bottom surface of the flow path plate 10. Meanwhile, the flow path plate 10 may be integrally formed with the vibrating plate 20. Also, the flow path plate 10 may be integrally formed with the nozzle plate 30.

The manifold 11 is a path through which ink is supplied from an ink storage (not shown) to the respective pressure chambers 13. The restrictors 12 are paths through which ink is supplied from the manifold 11 to the respective pressure chambers 13. The pressure chambers 13 are arranged on one side or both sides of the manifold 11 and are filled with ink to be ejected. The nozzles 31 are formed through the nozzle plate 30 to communicate with the pressure chambers 13. The vibrating plate 20 is adhered to the top surface of the flow path plate 10 to cover the pressure chamber 13. The vibrating plate 20 is deformed due to the drive of the piezoelectric actuator 40 and provides a pressure variation required for ejecting ink to the respective pressure chambers 13. The piezoelectric actuator 40 includes a lower electrode 41, a piezoelectric layer 42, and an upper electrode 43 that are sequentially stacked on the vibrating plate 20. The lower electrode 41 is disposed on the entire surface of the vibrating plate 20 and functions as a common electrode. The piezoelectric layer 42 is disposed on the lower electrode 42 over the respective pressure chambers 13. The upper electrode 43 is disposed on the piezoelectric layer 42 and functions as a drive electrode for applying a voltage to the piezoelectric layer 42.

In the inkjet printhead having the above-described construction, the surface treatment of the nozzle plate 30 directly affects the ink ejecting performance of the inkjet printhead, for example, the straightness and ejection rate of droplets of ink ejected via the nozzles 31. That is, in order to improve the ink ejecting performance of the inkjet printhead, an inner wall of the nozzle 31 must be ink-philic, while the surface of the nozzle plate 30 outside the nozzle 31 must be ink-phobic. Specifically, when the inner wall of the nozzle 31 is ink-philic, the inner wall of the nozzle 31 makes a small contact angle with ink, so that the capillary force of the nozzle 31 increases. Thus, a time taken to refill ink can be shortened to increase the spray frequency of the nozzle 31. Also, when the surface of the nozzle plate 30 outside the nozzle 31 is ink-phobic, the surface of the nozzle plate 30 can be prevented from being wet with ink so that the straightness of ejected ink can be ensured. An ink-phobic coating layer formed on the surface of the nozzle plate 30 should satisfy the two following requirements. First, the ink-phobic coating layer must make a large contact angle with ink. Second, after ejecting ink, the contact angle of the ink-phobic coating layer with the ink must be maintained constant in time. In other words, the ink-phobic coating layer should have high durability.

Meanwhile, when ink remains around the nozzle 31 during a printing process using the inkjet printhead, the properties of subsequently ejected ink are greatly degraded. Thus, in order to prevent the performance of the inkjet printhead from deteriorating, the surface of the nozzle plate 30 outside the nozzle 31 can be periodically wiped using a solvent, the chief ingredient of ink, to inhibit the ink from remaining around the nozzle 31. However, when the solvent used for cleaning is not completely removed from the surface of the nozzle plate 30, the remaining solvent also adversely affects the ejecting properties of ejected ink. In other words, when the entire surface of the nozzle plate 30 outside the nozzle 31 has an ink-phobic property, it is difficult to control the position of the solvent left on the surface of the nozzle plate 30 after a wiping process, thus degrading the ejecting properties of ink.

SUMMARY OF THE INVENTION

The present general inventive concept provides a nozzle plate of an inkjet printhead, which can prevent ink or a solvent from remaining around a nozzle to improve ink ejecting performance, and a method of manufacturing the nozzle plate.

Additional aspects and utilities of the present general inventive concept will be set forth in part in the description which follows and, in part, will be obvious from the description, or may be learned by practice of the general inventive concept.

The foregoing and/or other aspects of the present general inventive concept are achieved by providing a nozzle plate of an inkjet printhead, which includes a substrate through which nozzles are formed; an ink-philic coating layer formed on an outer surface of the substrate and inner walls of the nozzles; and an ink-phobic coating layer selectively formed on the ink-philic coating layer disposed around the nozzles.

The ink-phobic coating layer may be formed to enclose the nozzles.

The substrate may be formed of silicon, and the ink-philic coating layer may be formed of thermally oxidized silicon.

The ink-phobic coating layer may be formed of perfluorinated silane or a fluorine polymer.

The foregoing and/or other aspects of the present general inventive concept may also be achieved by providing a nozzle plate of an inkjet printhead, which includes a substrate through which nozzles are formed; a first ink-philic coating layer formed on an outer surface of the substrate and inner walls of the nozzles; a second ink-philic coating layer formed to cover the first ink-philic coating layer formed on the outer surface of the substrate; and an ink-phobic coating layer selectively formed only on the second ink-philic coating layer around the nozzles.

The first ink-philic coating layer may be formed of thermally oxidized silicon, and the second ink-philic coating layer may be formed of deposited silicon oxide.

The surface of the second ink-philic coating layer may have a root mean square (RMS) roughness of 0.5 to 2 nm.

The foregoing and/or other aspects of the present general inventive concept may also be achieved by providing a method of manufacturing a nozzle plate of an inkjet printhead. The method includes preparing a substrate through which nozzles are formed; forming an ink-philic coating layer on an outer surface of the substrate and inner walls of the nozzles; and selectively forming an ink-phobic coating layer only on the ink-philic coating layer formed around the nozzles.

The ink-phobic coating layer may be formed using a microcontact printing technique. In this case, the formation of the ink-phobic coating layer may include preparing a stamp including protrusions with a predetermined shape on a bottom surface; adhering an ink-phobic material to bottom surfaces of the protrusions of the stamp; locating the stamp over the substrate having the ink-philic coating layer and pressing the stamp to form the ink-phobic coating layer on the ink-philic coating layer formed around the nozzles; and detaching the stamp from the ink-phobic coating layer.

The stamp may be formed of one selected from a group consisting of poly(dimethylsiloxane) (PDMS), glass, quartz, and silicon.

The foregoing and/or other aspects of the present general inventive concept may also be achieved by providing a method of manufacturing a nozzle plate of an inkjet printhead. The method includes preparing a substrate through which nozzles are formed; forming a first ink-philic coating layer on an outer surface of the substrate and inner walls of the nozzles; forming a second ink-philic coating layer to cover the first ink-philic coating layer formed on the outer surface of the substrate; and selectively forming an ink-phobic coating layer only on the second ink-philic coating layer formed around the nozzles.

The second ink-philic coating layer may be formed by depositing silicon oxide on the first ink-philic coating layer using one of a chemical vapor deposition (CVD) process and a physical vapor deposition (PVD) process.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
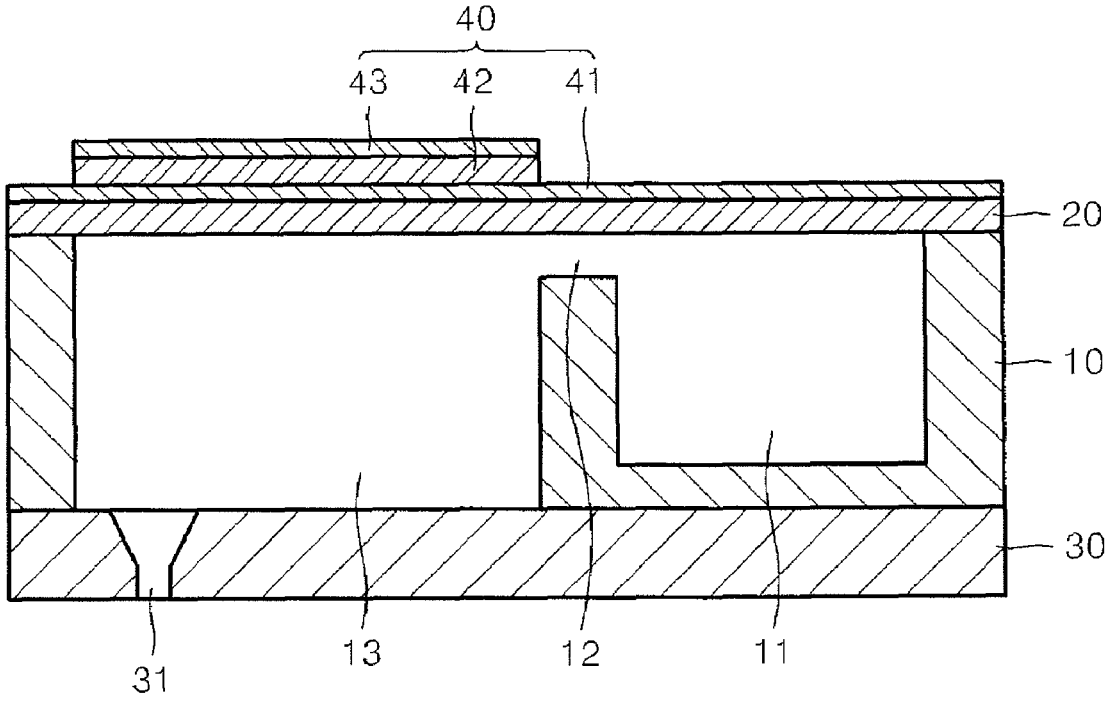
FIG. 1 (PRIOR ART)
FIG. 1 is a schematic cross-sectional view of a conventional piezoelectric inkjet printhead as an example of a conventional inkjet printhead.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
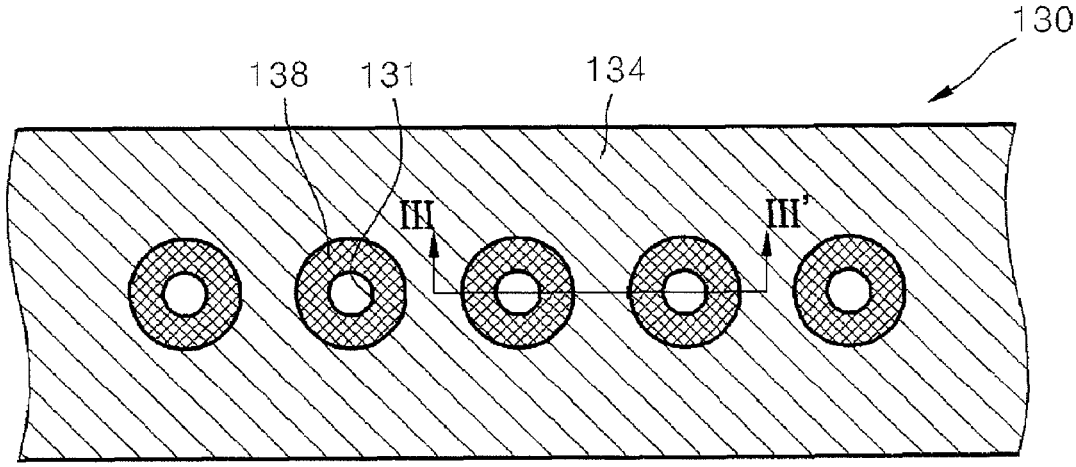
FIG. 2 is a plan view of a nozzle plate for an inkjet printhead according to an embodiment of the present general inventive concept.
Figure 3:
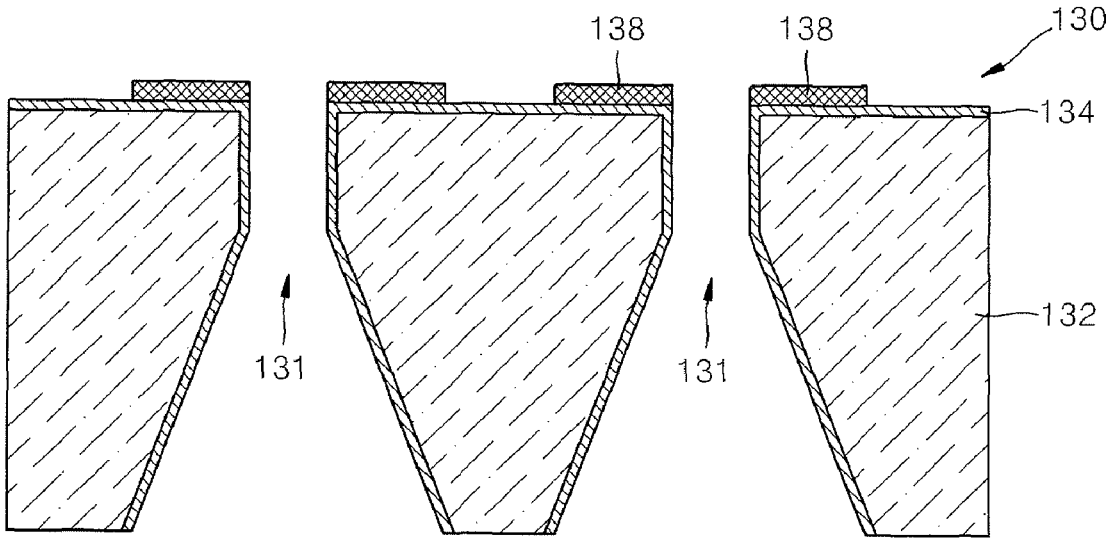
FIG. 3 is a cross-sectional view taken along a line III-III' of FIG. 2.

FIG. 2 is a plan view of a nozzle plate 130 of an inkjet printhead according to an embodiment of the present general inventive concept, and FIG. 3 is a cross-sectional view taken along a line III-III' of FIG. 2.

Referring to FIGS. 2 and 3, the nozzle plate 130 includes a substrate 132 having nozzles 131, an ink-philic coating layer 134 formed on the entire surface of the substrate 132, and an ink-phobic coating layer 138 that is selectively formed on the ink-philic coating layer 134.

The substrate 132 may be formed of silicon. A plurality of nozzles 131 to eject ink are formed through the substrate 132. Also, the ink-philic coating layer 134 is formed on inner walls of the nozzles 131 and an outer surface of the substrate 132. The ink-philic coating layer 134 may be formed of thermally oxidized silicon. In this case, the ink-philic coating layer 134 may be obtained by thermally oxidizing the surface of the substrate 132 formed of silicon.

The ink-phobic coating layer 138 may be selectively formed only on the ink-philic coating layer 134 formed around the nozzle 131. The ink-phobic coating layer 138 may be formed to enclose the nozzles 131. The ink-phobic coating layer 138 may be selectively formed on the ink-philic coating layer 134 using a microcontact printing technique as described later. The ink-phobic coating layer 138 may be formed of, for example, perfluorinated silane or a fluorine polymer. Meanwhile, FIG. 2 illustrates the ink-phobic coating layer 138 enclosing the nozzle 131 in a circular shape, but the present general inventive concept is not limited thereto. That is, the ink-phobic coating layer 138 may be formed to enclose the nozzles 131 in a rectangular shape or another polygonal shape or be arranged in yet another shape.

As described above, in the nozzle plate 130 according to this embodiment, the ink-phobic layer 138 is selectively formed only around the nozzles 131 on the outer surface of the nozzle plate 130. Thus, when a solvent used to wipe the nozzle plate 130 or ink remains on the outer surface of the nozzle plate 130, the solvent or ink remains not around the nozzles 131 where the ink-phobic coating layer 138 is formed but on the ink-philic coating layer 134 disposed around the ink-phobic coating layer 138. Thus, the solvent or ink can be prevented from remaining around the nozzles 131, thereby improving the ejecting performance of the inkjet printhead.

Figure 4:
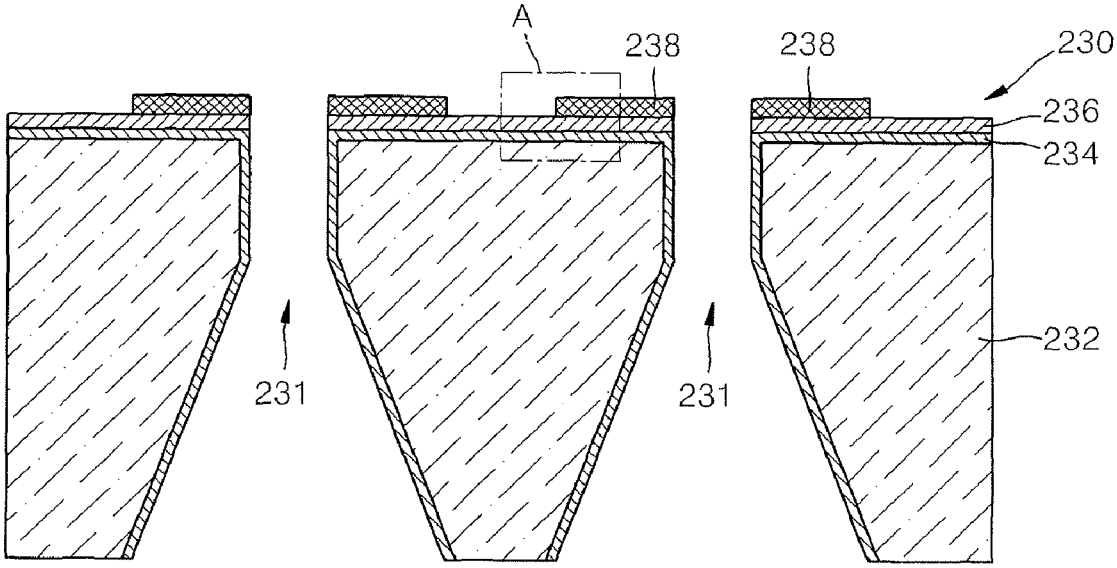
FIG. 4 is a plan view of a nozzle plate for an inkjet printhead according to another embodiment of the present general inventive concept.
Figure 5:
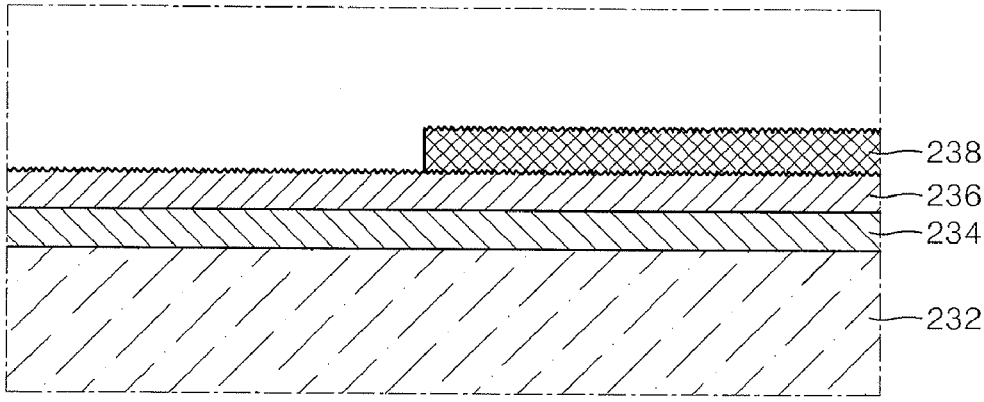
FIG. 5 is a magnified view of portion "A" of FIG. 4.

FIG. 4 is a plan view of a nozzle plate 230 of an inkjet printhead according to another embodiment of the present general inventive concept, and FIG. 5 is a magnified view of portion "A" of FIG. 4.

Referring to FIGS. 4 and 5, the nozzle plate 230 includes a substrate 232 having nozzles 231, a first ink-philic coating layer 234 formed on the entire surface of the substrate 232, a second ink-philic coating layer 236 formed on the first ink-philic coating layer 243, and an ink-phobic coating layer 238 that is selectively formed on the second ink-philic coating layer 236.

The substrate 232 may be formed of silicon. A plurality of nozzles 231 to eject ink are formed through the substrate 232. Also, the first ink-philic coating layer 234 is formed on inner walls of the nozzles 231 and an outer surface of the substrate 232. The first ink-philic coating layer 234 may be formed of thermally oxidized silicon. In this case, the first ink-philic coating layer 234 may be obtained by thermally oxidizing the surface of the substrate 232 formed of silicon.

The second ink-philic coating layer 236 may be formed to cover the first ink-philic coating layer 234 formed on the outer surface of the substrate 232. The second ink-philic coating layer 236 may be formed of deposited silicon oxide. Specifically, the second ink-philic coating layer 236 may be obtained by depositing silicon oxide using a chemical vapor deposition (CVD) process or a physical vapor deposition (PVD) process on the first ink-philic coating layer 234 formed of thermally oxidized silicon. The PVD process may be an electron beam (e-beam) evaporation process. As described above, when the second ink-philic coating layer 236 is formed by depositing silicon oxide on the first ink-philic coating layer 234 formed of thermally oxidized silicon, the surface roughness of the second ink-philic coating layer 236 is much higher than that of the first ink-philic coating layer 234, as illustrated in FIG. 5. Specifically, the surface of the second ink-philic coating layer 236 may have a root mean square (RMS) roughness of about 0.5 to 2 nm. As the surface roughness of the second ink-philic coating layer 236 increases, the surface area of the second ink-philic coating layer 236 increases. Thus, the surface of the second ink-philic coating layer 236 has a good ink-philic property.

The ink-phobic coating layer 238 is selectively formed only on the second ink-philic coating layer 236 disposed around the nozzles 231. The ink-phobic coating layer 238 may be formed to enclose the nozzles 231 in various shapes. The ink-phobic coating layer 238 may be selectively formed on the ink-philic coating layer 234 using a microcontact printing technique as described later. The ink-phobic coating layer 238 may be formed of, for example, perfluorinated silane or a fluorine polymer. As described above, when the ink-phobic coating layer 238 is formed on the second ink-philic coating layer 236 having a high surface roughness, the ink-phobic coating layer 238 has a high surface roughness like the second ink-philic coating layer 236 as illustrated in FIG. 5. Thus, the surface area of the ink-phobic coating layer 238 increases so that a larger amount of an ink-phobic material can be formed on the surface of the second ink-philic coating layer 236. As a result, the surface of the ink-phobic coating layer 238 can have a good ink-phobic property. Also, when the ink-phobic coating layer 238 is formed on the second ink-philic coating layer 236 having a high surface roughness, the adhesion of the second ink-philic coating layer 236 to the ink-phobic coating layer 238 is increased, thereby improving the durability of the ink-phobic coating layer 238.

As stated above, in the present embodiment, the second ink-philic coating layer 236 having a high surface roughness is formed on the first ink-philic coating layer 234 and the ink-phobic coating layer 238 is selectively formed on the second ink-philic coating layer 236. Thus, the ink-phobic coating layer 238 formed around the nozzles 231 can have an excellent ink-phobic property, while the second ink-philic coating layer 236 formed around the ink-phobic coating layer 238 can have an excellent ink-philic property. Therefore, ink or a solvent can be effectively prevented from remaining around the nozzles 231 so that the ejecting performance of the inkjet printhead can be further enhanced. Also, the ink-philic property of the second ink-philic coating layer 236 can be markedly improved, thereby inhibiting the contamination and degradation of the second ink-philic coating layer 236 due to environment in time.

Figure 6:
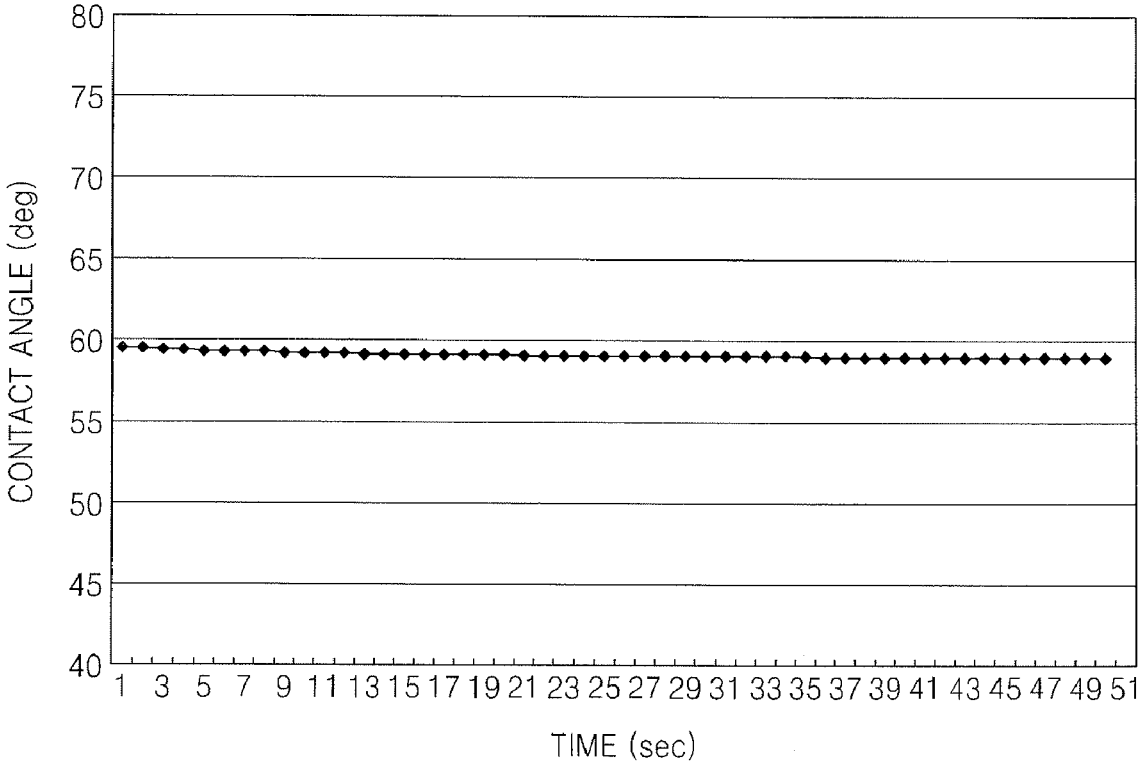
FIG. 6 is a graph of a contact angle of the surface of an ink-phobic coating layer formed on the nozzle plate shown in FIG. 4.

FIG. 6 is a graph of a contact angle of the surface of the ink-phobic coating layer 238 formed on the nozzle plate 230 shown in FIG. 4. In FIG. 6, the result was obtained when the ink-phobic coating layer 238 was formed of a fluorine polymer and selectively formed on the second ink-philic coating layer 236 using a microcontact printing technique.

Referring to FIG. 6, when the contact angle of the surface of the ink-phobic coating layer 238 was measured using a DiPropylene glycol Methyl ether Acetate (DPMA), the ink-phobic coating layer 238 was about 60°. From the result, it can be seen that the ink-phobic coating layer 238 formed on the nozzle plate 230 according to the current embodiment has an excellent ink-phobic property.

Hereinafter, methods of manufacturing a nozzle plate of an inkjet printhead according to embodiments of the present general inventive concept will be described.

FIGS. 7 through 11 are cross-sectional views illustrating a method of manufacturing the nozzle plate of the inkjet printhead shown in FIG. 3 according to an embodiment of the present general inventive concept.

Figure 7:
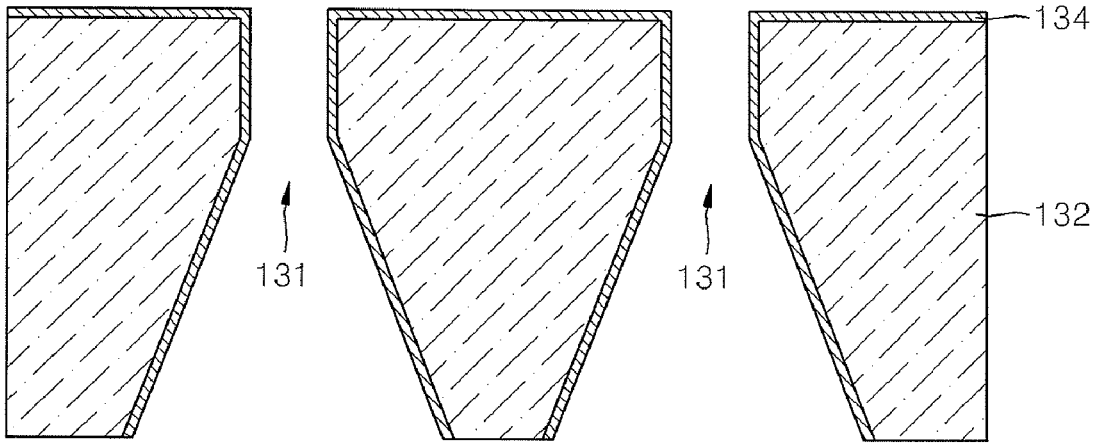
FIGS. 7 through 11 are cross-sectional views illustrating a method of manufacturing the nozzle plate of the inkjet printhead shown in FIG. 3 according to an embodiment of the present general inventive concept.

Referring to FIG. 7, a substrate 132 having a plurality of nozzles 131 is prepared. The substrate 132 may be formed of silicon. Also, an ink-philic coating layer 134 is formed on the entire surface of the substrate 132, that is, on inner walls of the nozzles 131 and an outer surface of the substrate 132. The ink-philic coating layer 134 may be formed of thermally oxidized silicon. In this case, the ink-philic coating layer 134 may be formed by thermally oxidizing the surface of the substrate 132 formed of silicon.

Next, an ink-phobic coating layer (refer to 138 of FIG. 11) is selectively formed only on the ink-philic coating layer 134 formed around the nozzles 131. The selective formation of the ink-phobic coating layer 138 may be performed using a microcontact printing technique as described now in more detail.

Figure 8:
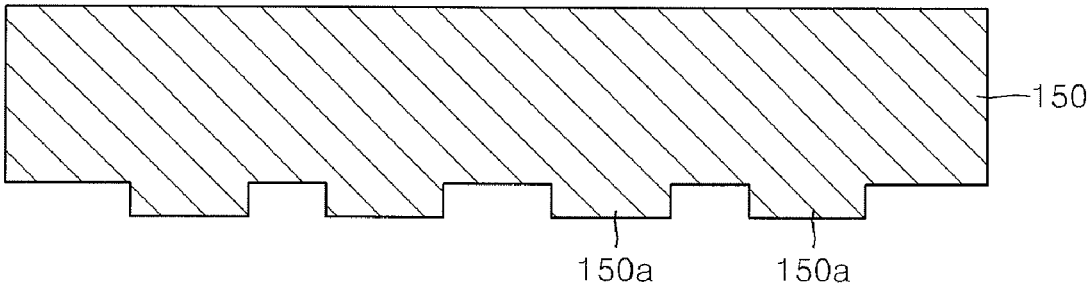
Figure 9:
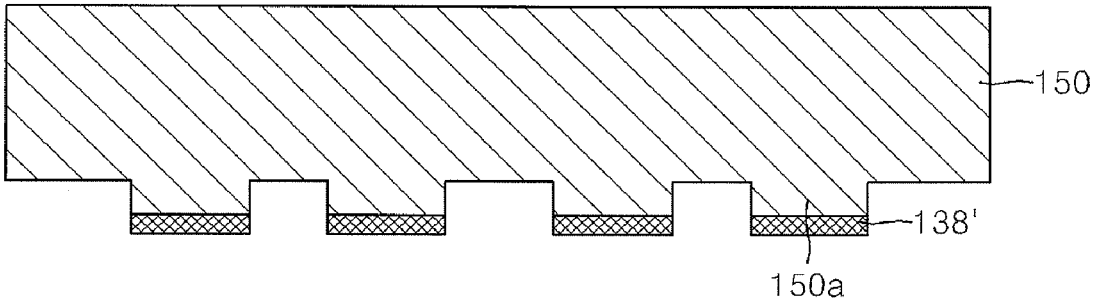

Referring to FIG. 8, a stamp 150 having protrusions **150*a* with a predetermined shape is prepared. The stamp 150 may be formed of poly(dimethylsiloxane) (PDMS), glass, quartz, or silicon, but the present general inventive concept is not limited thereto. The protrusions 150*a* disposed under the stamp 150 may be formed in a shape enclosing the nozzles 131. Referring to FIG. 9, an ink-phobic material 138' is attached to bottom surfaces of the protrusions 150*a* of the stamp 150. The ink-phobic material 138'** may be a fluorine polymer or perfluorinated silane.

Figure 10:
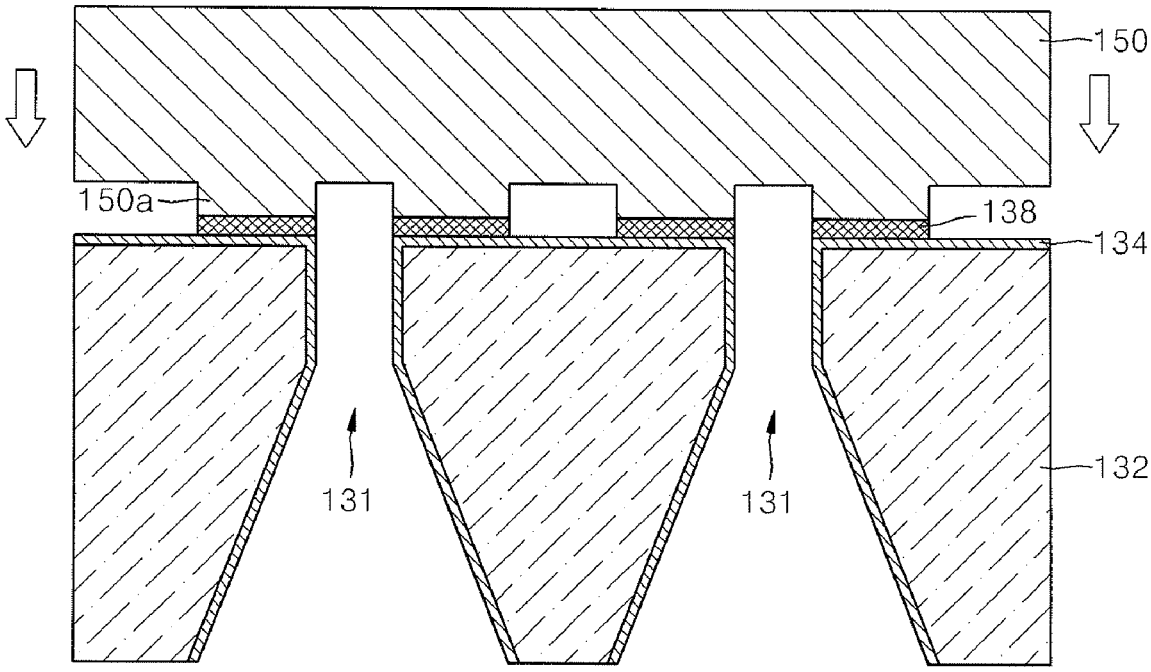
Figure 11:
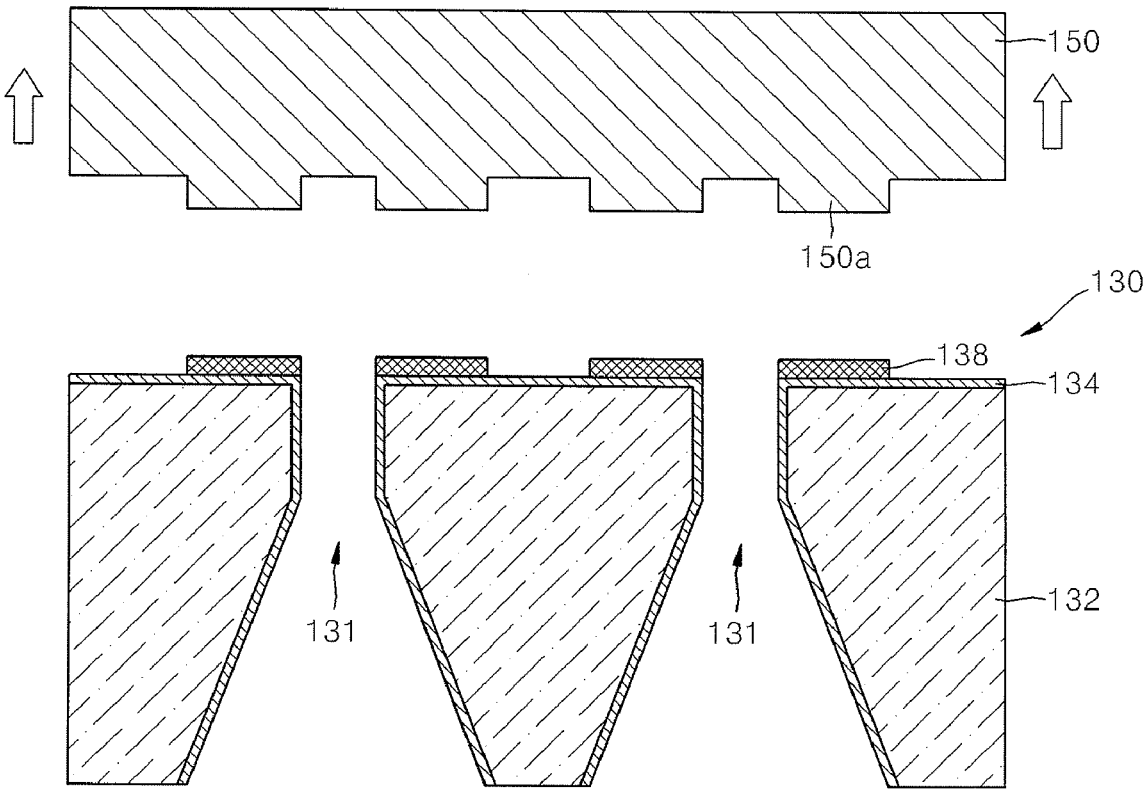

Referring to FIG. 10, the stamp 150 to which the ink-phobic material 138' is attached is located over the substrate 132 having the ink-philic coating layer 134. Thereafter, when the stamp 150 is pressed to the substrate 132 having the ink-philic coating layer 134, an ink-phobic coating layer 138 is formed on the ink-philic coating layer 134 formed around the nozzles 131. The ink-phobic coating layer 138 may be formed to enclose the nozzles 131. Finally, referring to FIG.

11, the stamp 150 is detached from the ink-phobic coating layer 138, thereby completing the nozzle plate according to the current embodiment.

FIGS. 12 through 16 are cross-sectional views illustrating a method of manufacturing the nozzle plate of the inkjet printhead shown in FIG. 4, according to another embodiment of the present general inventive concept.

Figure 12:
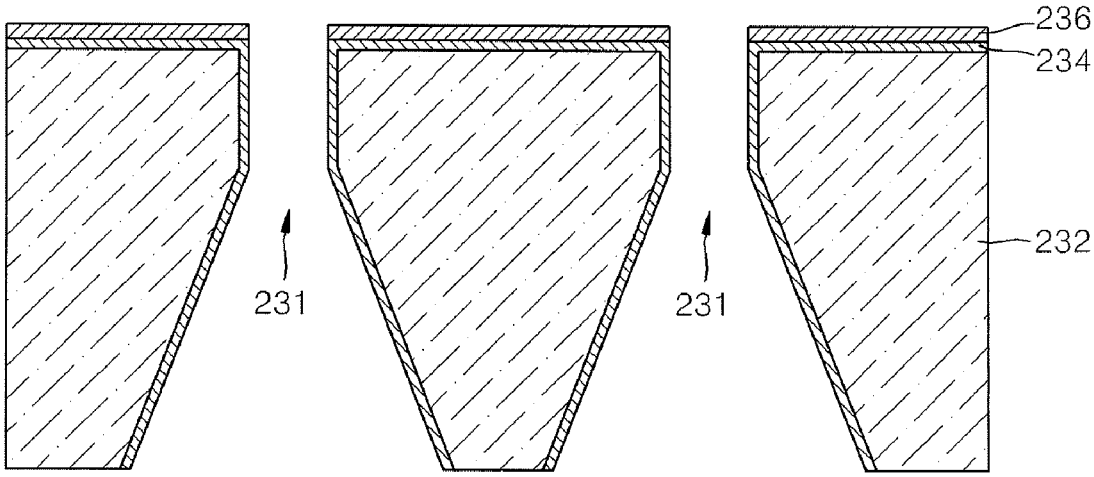
FIGS. 12 through 16 are cross-sectional views illustrating a method of manufacturing the nozzle plate of the inkjet printhead shown in FIG. 4 according to another embodiment of the present general inventive concept.

Referring to FIG. 12, a substrate 233 through which nozzles 231 are formed is prepared. The substrate 232 may be formed of silicon. A first ink-philic coating layer 234 is formed on the entire surface of the substrate 232, that is, on inner walls of the nozzles 231 and an outer surface of the substrate 232. The first ink-philic coating layer 234 may be formed of thermally oxidized silicon. In this case, the first ink-philic coating layer 234 may be formed by thermally oxidizing the surface of the substrate 232 formed of silicon.

Next, a second ink-philic coating layer 236 is formed to cover the first ink-philic coating layer 234 formed on the outer surface of the substrate 232. The second ink-philic coating layer 236 may be formed of deposited silicon oxide. Specifically, the second ink-philic coating layer 236 may be formed by depositing silicon oxide on the first ink-philic coating layer 234 formed of thermally oxidized silicon using a chemical vapor deposition (CVD) process or a physical vapor deposition (PVD) process. The PVD process may be an e-beam evaporation process. When the second ink-philic coating layer 236 is formed by depositing silicon oxide on the first ink-philic coating layer 234 formed of thermally oxidized silicon, the surface roughness of the second ink-philic coating layer 236 becomes much higher than that of the first ink-philic coating layer 234 and thus, the surface of the second ink-philic coating layer 236 has a good ink-philic property. The surface of the second ink-philic coating layer 236 can have an RMS roughness of about 0.5 to 2 nm.

Next, an ink-phobic coating layer (refer to 238 of FIG. 16) is selectively formed only on the second ink-philic coating layer 236 formed around the nozzles 231. The selective formation of the ink-phobic coating layer 238 may be performed using a microcontact printing technique as described now in more detail.

Figure 13:
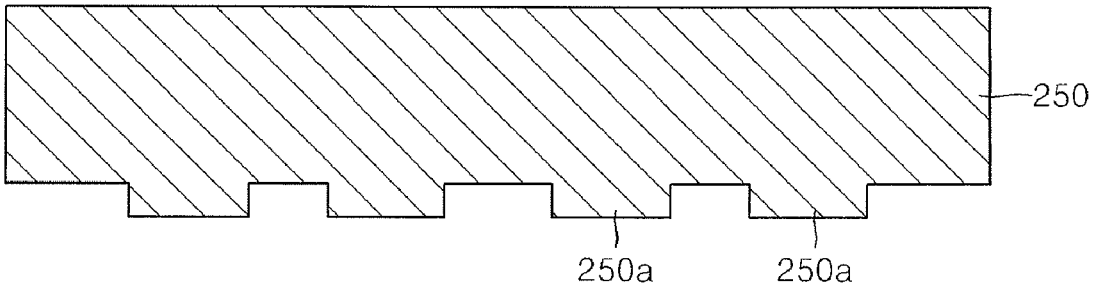
Figure 14:
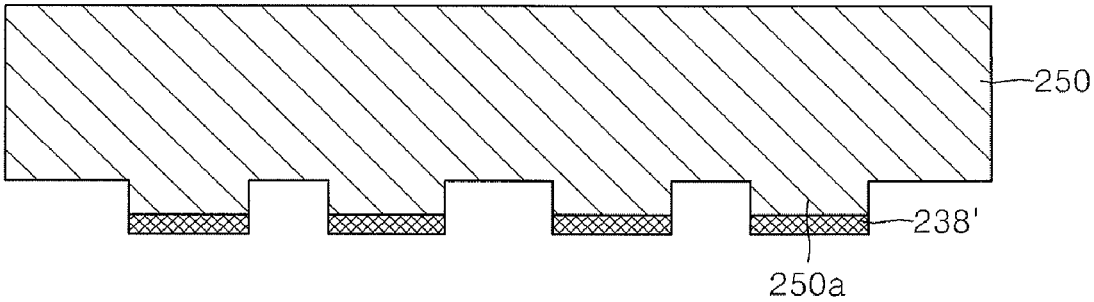

Referring to FIG. 13, a stamp 250 having protrusions 250*a* with a predetermined shape is prepared. The stamp 250 may be formed of PDMS, glass, quartz, or silicon, but the present general inventive concept is not limited thereto. The protrusions 250*a* formed under the stamp 250 may be formed in a shape to enclose the nozzles 231. Referring to FIG. 14, an ink-phobic material 238' is attached to bottom surfaces of the protrusions 250*a* of the stamp 250. The ink-phobic material 138' may be a fluorine polymer or perfluorinated silane.

Figure 15:
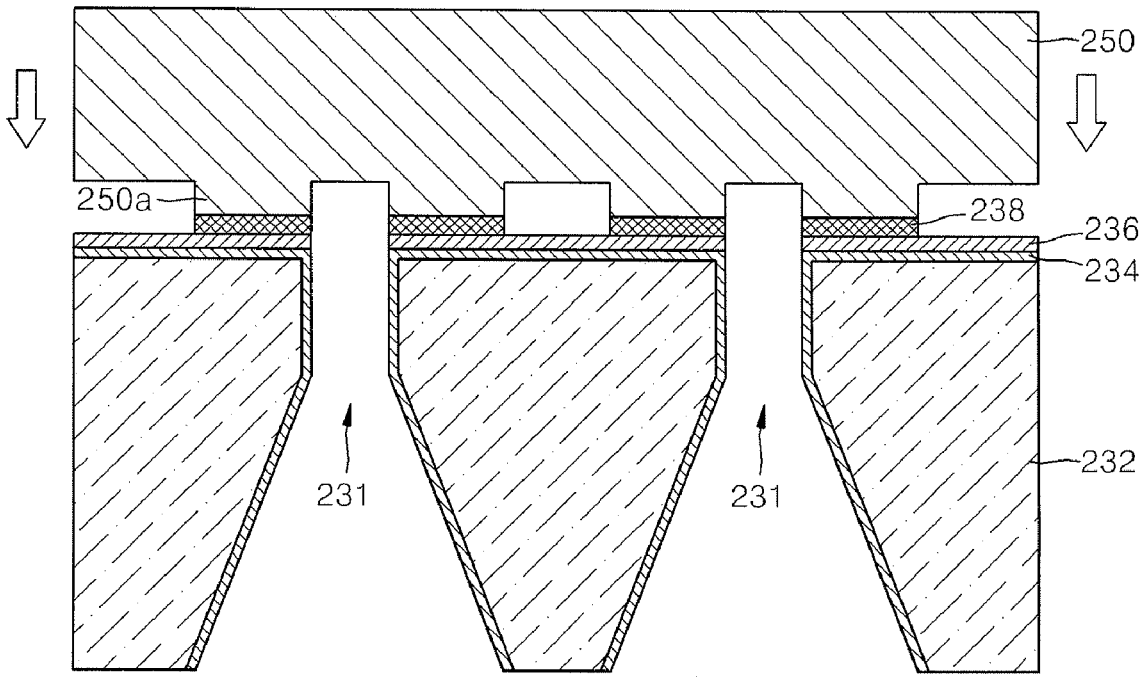
Figure 16:
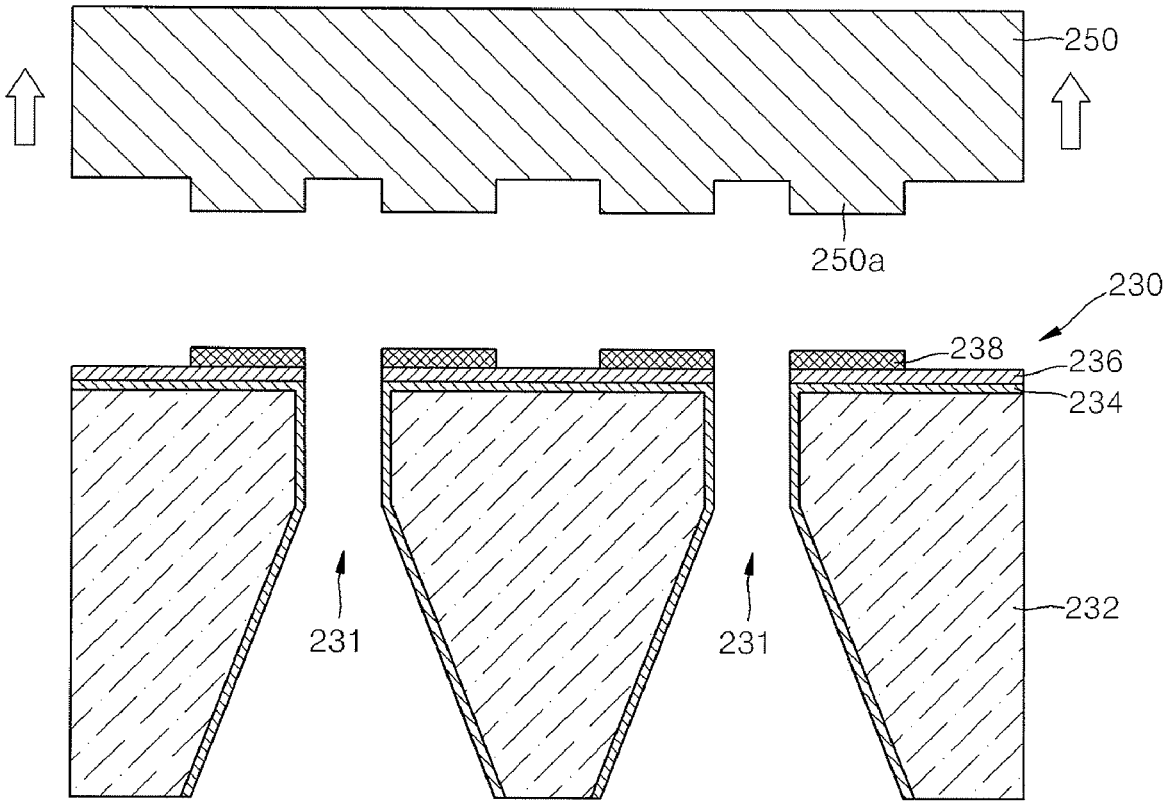

Referring to FIG. 15, the stamp 250 to which the ink-phobic material 238' is attached is located over the substrate 232 having the first and second ink-philic coating layers 234 and 236. Thereafter, when the stamp 250 is pressed, an ink-phobic coating layer 238 is formed on the second ink-philic coating layer 236 formed around the nozzles 231. The ink-phobic coating layer 238 may be formed to enclose the nozzles 231. When the ink-phobic coating layer 238 is formed on the second ink-philic coating layer 236 having a high surface roughness, the ink-phobic coating layer 238 has a high surface roughness like the second ink-philic coating layer 236, so that the surface of the ink-phobic coating layer 238 has a good ink-phobic property. Finally, referring to FIG. 16, the stamp 250 is detached from the ink-phobic coating layer 238, thereby completing the nozzle plate according to the current embodiment of the present general inventive concept.

As explained thus far, a nozzle plate for an inkjet printhead and a method of manufacturing the nozzle plate according to the present general inventive concept have the following effects.

First, an ink-phobic coating layer is selectively formed on an ink-philic coating layer formed on the surface of a substrate so that ink or a solvent can be prevented from remaining around nozzles, thereby enhancing the ejecting performance of the inkjet printhead.

Second, a second ink-philic coating layer having a high surface roughness is formed on a first ink-philic coating layer formed on the surface of a substrate, and a ink-phobic coating layer is formed on the second ink-philic coating layer, thereby preventing ink or a solvent from remaining around nozzles more effectively. Thus, the ejecting performance of the inkjet printhead can be further improved. Also, the contamination and degradation of the second ink-philic coating layer due to environment can be inhibited.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A nozzle plate of an inkjet printhead, the nozzle plate comprising:

a substrate through which nozzles are formed;

a first ink-philic coating layer formed on an outer surface of the substrate and inner walls of the nozzles;

a second ink-philic coating layer formed to cover the first ink-philic coating layer formed on the outer surface of the substrate; and an ink-phobic coating layer selectively formed only on the second ink-philic coating layer around the nozzles.

2. The nozzle plate of claim 1, wherein the ink-phobic coating layer is formed to enclose the nozzles.

3. The nozzle plate of claim 1, wherein the substrate is formed of silicon.

4. The nozzle plate of claim 1, wherein the first ink-philic coating layer is formed of thermally oxidized silicon.

5. The nozzle plate of claim 1, wherein the second ink-philic coating layer is formed of deposited silicon oxide.

6. The nozzle plate of claim 1, wherein the surface of the second ink-philic coating layer has a root mean square (RMS) roughness of 0.5 to 2 nm.

7. The nozzle plate of claim 1, wherein the ink-phobic coating layer is formed of perfluorinated silane or a fluorine polymer.

* * * * *